United States Patent [19]

Eittreim

[11] Patent Number: 4,804,094

[45] Date of Patent: Feb. 14, 1989

[54] OPEN WALL STORAGE ASSEMBLY

[76] Inventor: William D. Eittreim, P.O. Box 659, Sun Valley, Id. 83353

[21] Appl. No.: 120,627

[22] Filed: Nov. 13, 1987

[51] Int. Cl.[4] ..... A47F 5/08

[52] U.S. Cl. ..... 211/88; 52/317; 211/134

[58] Field of Search ..... 211/88, 134, 90, 187; 52/317, 696, 406, 36

[56] References Cited

U.S. PATENT DOCUMENTS

| | | | |
|---|---|---|---|
| 405,794 | 6/1889 | O'Donnell | 52/317 |
| 2,994,114 | 8/1961 | Black | 52/317 |
| 3,123,220 | 3/1964 | Hanson | 211/88 |
| 3,334,461 | 8/1967 | York | 52/317 |
| 3,660,591 | 5/1972 | Schultz et al. | 52/36 |

*Primary Examiner*—Ramon S. Britts
*Assistant Examiner*—Sarah A. Lechok Eley
*Attorney, Agent, or Firm*—Nelson & Roediger

[57] ABSTRACT

An open wall storage assembly for use with unfinished walls including a large area panel having vertical U-shaped channels for receiving the wall supports therein so that the assembly extends into the wall region. Transverse shelving is provided for affixation at desired locations to provide both structural support and serve as fire breaks within the wall region.

7 Claims, 2 Drawing Sheets

FIG. 1
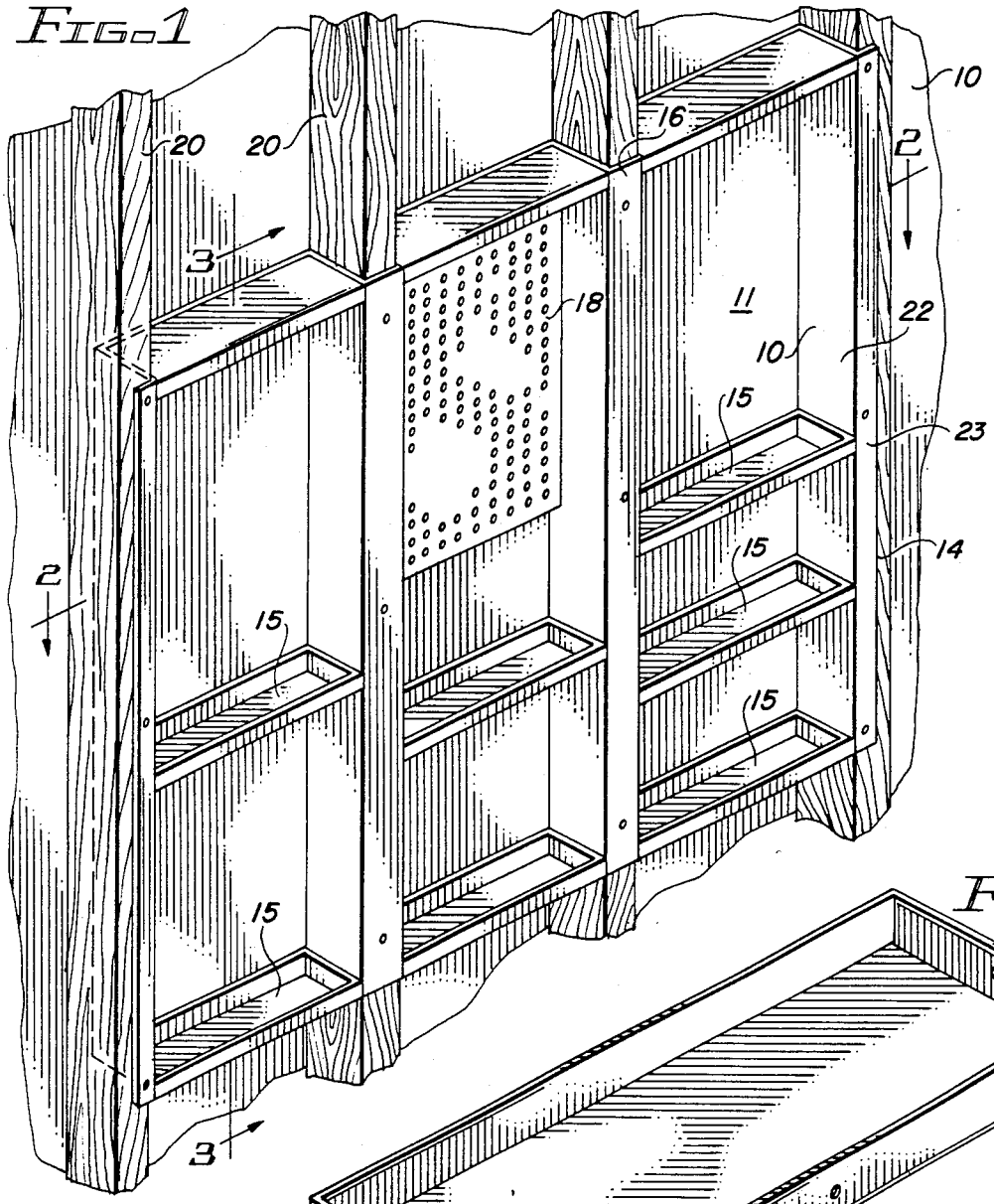
FIG. 4
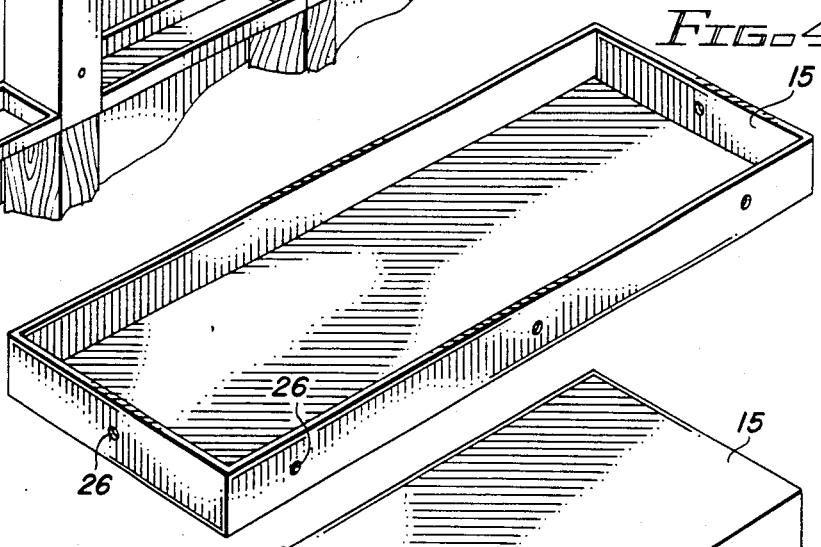
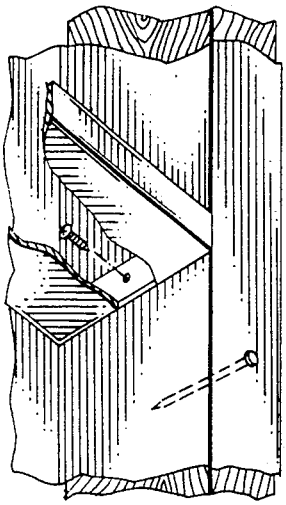
FIG. 6
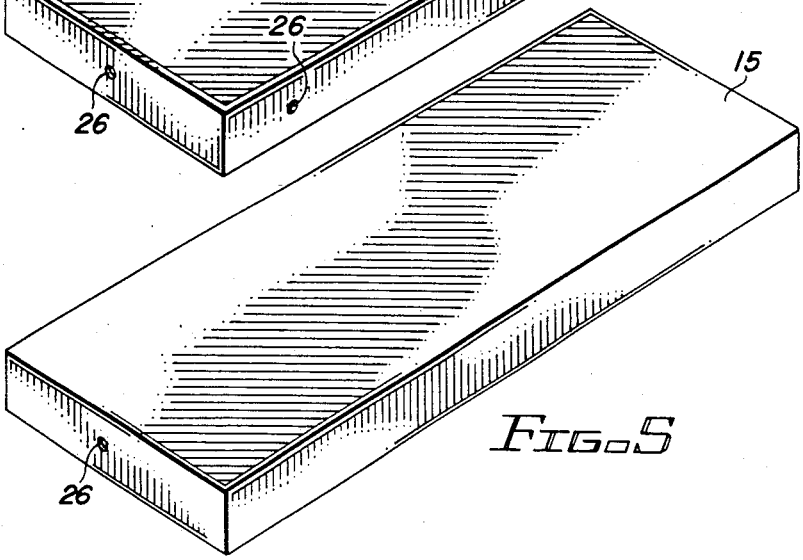
FIG. 5

OPEN WALL STORAGE ASSEMBLY

BACKGROUND OF THE INVENTION

This invention relates to an open wall storage assembly for use with unfinished walls and, in particular, a wall storage assembly for use in a wall region containing a plurality of vertical wall supports.

In present day home construction, large areas of interior walls are left unfinished, typically in the basement and garage areas, although work rooms and laundry areas may be similarly unfinished. The homeowner desirous of utilizing this wall area typically provides shelving affixed to the exposed or internal surface of the vertical supports, thus providing storage which protrudes into the room area. A similar result obtains when closed wall storage assemblies such as cabinetry, are also affixed. Since these areas are frequently located in regions where space is at a premium, for example, the area adjacent customary automobile parking in garage facilities and areas adjacent the location of laundry equipment, the inability of the homeowner to effectively utilize the regions between vertical wall supports results in already crowded areas becoming further confined.

While a variety of different shelving schemes and outwardly expandable cabinetry is available to promote storage in these areas, the homeowner is faced with a loss of room space especially where the cabinetry contains doors. Furthermore, the mounting of these storage assemblies on the relatively narrow face of the vertical support members utilized in house construction frequently requires the use of additional supporting structure underlying the assembly. This type of storage is characterized by the lack of utility of the region located within the wall between the vertical wall supports. In the construction of the typical house, it is common to find horizontal structural supports placed for fire break purposes and occasionally for structural rigidity between adjacent wall supports. If these members are present, the homeowner is reluctant to disturb them from both a structural and a fire retardant point of view. If these horizontal members are not present, the region between vertical supports and behind any such storage apparatus mounted on the narrow surfaces of the wall supports can act as a flue in the eventuality of fire along the base of the wall.

Accordingly, it is a primary object of the present invention to provide an open wall storage assembly for use with unfinished walls which is readily installable by the homeowner and effectively utilizes the region between adjacent vertical wall supports heretofore ignored in the construction of storage means. Furthermore, the invention is characterized by a large area integral member which is utilized in surrounding engagement with adjacent vertical members and has flange members on the opposing vertical ends for affixation to the vertical wall supports. In the present invention, the individual installer can place the transverse shelving members at locations to fit his particular needs. Thus, the invention is located in heretofore unused areas in the support wall so as not to reduce the usable regions within the building.

SUMMARY OF THE INVENTION

The open wall storage assembly constructed in accordance with the present invention is intended for placement in an opening in a wall containing a number of uniformly spaced vertical wall support members or, as commonly referred to, wall studs, with the transverse shelving located between adjacent vertical wall supports.

The apparatus includes a large area panel having opposing vertical edges with the panel being dimensioned for placement in the wall opening. If the wall is entirely unfinished, the installer has unlimited opportunity to vary the height of the location at will. However, if the wall is being covered with wall board or the like, a suitable opening may be left to accommodate the present invention, or, in the alternative, the open storage apparatus may be installed prior to the affixation of a wall covering. The large area panel includes a plurality of U-shaped channel members which extend vertically and are spaced in accordance with the standard spacing of vertical wall supports. In the United States, the spacing of these supports, as required by Uniform Construction Codes, in a placement of 16 inches between centers of the wall supports. In addition to the centrally located vertical channels, vertical end members are affixed to opposing edges of the panel and are horizontally spaced so as to terminate on the adjacent surfaces of the vertical support members. Also, flange members are affixed to the vertical end members and extend outwardly or laterally therefrom so that the placement of the panel in the wall opening results in the ends and flange members contacting adjacent surfaces of a support member for attachment thereto.

A plurality of transverse members dimensioned to fit between adjacent support members for attachment to the panel prior to final affixation to the vertical support members of the structure are provided. These transverse members, when installed, provide a degree of structural rigidity, serve as fire breaks in the vertical passageways defined by the vertical support members, as well as serving as basal members for storage. The transverse members are provided with flanges about their peripheral region for fastening to the adjacent portion of the large area panel and for retention of articles stored thereon. In addition, the transverse members are preferably affixed to the broad area of the vertical wall supports when the unit is placed in the opening of the wall. As a result, the support for the items being stored is provided by the large area surface of the vertical wall supports.

The cost of manufacture of the present invention is substantially reduced by forming the large area panel, vertical end members and associated flange members as an integral unitary structure. This single piece structure can be formed of sheet metal or of molded plastic. In the case of a plastic structure, an additional advantage is obtained if the plastic permits slight deformation of the large area panel to accommodate variations in vertical support member spacing during construction. Further features and advantages of the present invention will become more readily apparent from the following detailed description of a specific embodiment thereof when taken in conjunction with the accompanying drawings.

BRIEF DESCRIPTION OF THE DRAWINGS

FIG. 1 is a view in perspective of a wall having the present invention affixed thereto.

FIGS. 4 and 5 show top and bottom perspective views of a transverse member utilized in the embodiment of FIG. 1.

FIG. 6 is a view of the underside of one end of a transverse member installed in the embodiment of FIG. 1.

DESCRIPTION OF THE PREFERRED EMBODIMENTS

Figure 2:
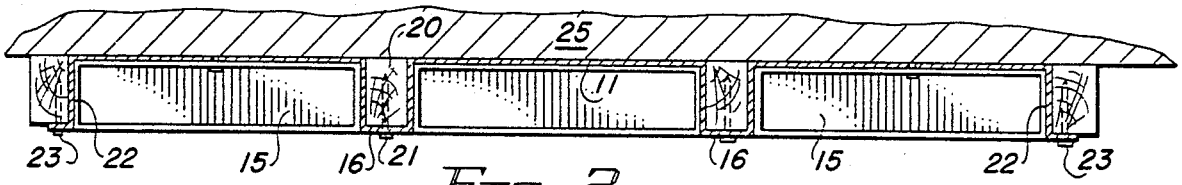
FIG. 2 is a top view in cross-section taken along line 2—2 of FIG. 1.

Referring now to FIG. 1, an interior wall of a structure is shown including a multiplicity of uniformly spaced vertical wall supports or studs 20 in accordance with the generally accepted building practices utilized in this country. The spacing of these vertical wall supports is typically 16 inches on centers and by that is meant that the horizontal distance between the centers of the inner facing surfaces of the vertical wall supports is 16 inches. The common vertical wall support, at least in the residential construction environment, is nominally 2 inches by 4 inches which has been reduced in practice to somewhat less in each dimension. The spacing and dimensions of the vertical wall supports is important in the installation of the present invention.

A large area panel 11 is shown extending between four adjacently spaced vertical wall supports 20. The panel contains two immediate vertical receiving members 16 which are U-shaped and extend from the top to the bottom of the panel. Each of these U-shaped panel members receives a vertical wall support 20 therein so as to be in surrounding engagement therewith. At either side of the panel 11 is a vertical end member 22 with associated flange 23 extending along its length. The end member 22 is orthogonal to the large area panel 11 so as to be adjacently received by the vertical wall support in the end position. Flange 23 extends orthogonally from the end member 22 so as to overlie at least a portion of the inner surface of the vertical wall support 20. In the preferred embodiment, the flange width is made less than the stud width to enable adjacent wall covering to be affixed thereto. A plurality of fasteners 21, typically nails, are used to secure the flange 23 to the corresponding vertical wall support 20. Also, fastening means 21 are utilized along the U-shaped channel members 16 in the same manner to secure the central portion of the large area panel to the associated vertical wall supports 20. A multiple hole region 18 is provided in the panel to receive commercially available fixtures if desired.

The top view of FIG. 2 shows the positioning of the large area panel 11 in position against the vertical wall supports. The channel members 16 surround the intermediate vertical wall supports and the vertical end members 22 are positioned against the large area surface of the end vertical wall supports. As mentioned, flange 23 overlies a portion of the innermost surface of the end wall support and receives fastening means 21 therein. It should be noted that the channel members also are secured to the intermediate vertical wall supports. The view in FIG. 2 is taken along line 2—2 of FIG. 1 below the top of the large area panel and shows the three transverse members 15 extending between adjacently spaced vertical wall supports 20. In practice, the rear-facing surface of the vertical wall supports 20 supports the exterior wall for the structure containing the present invention. Thus, plywood sheeting or a host of other materials are likely to be found at the rear of the vertical wall supports.

Figure 3:
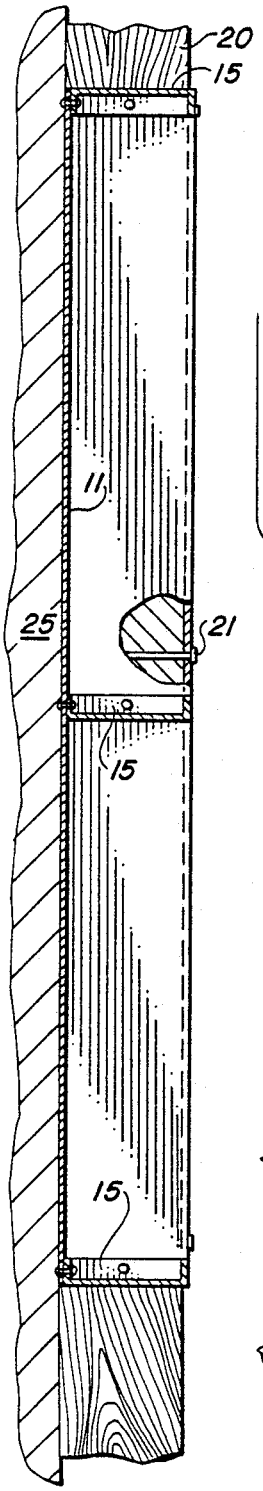
FIG. 3 is a side view in cross-section taken along line 3—3 of FIG. 1.
Figure 7:
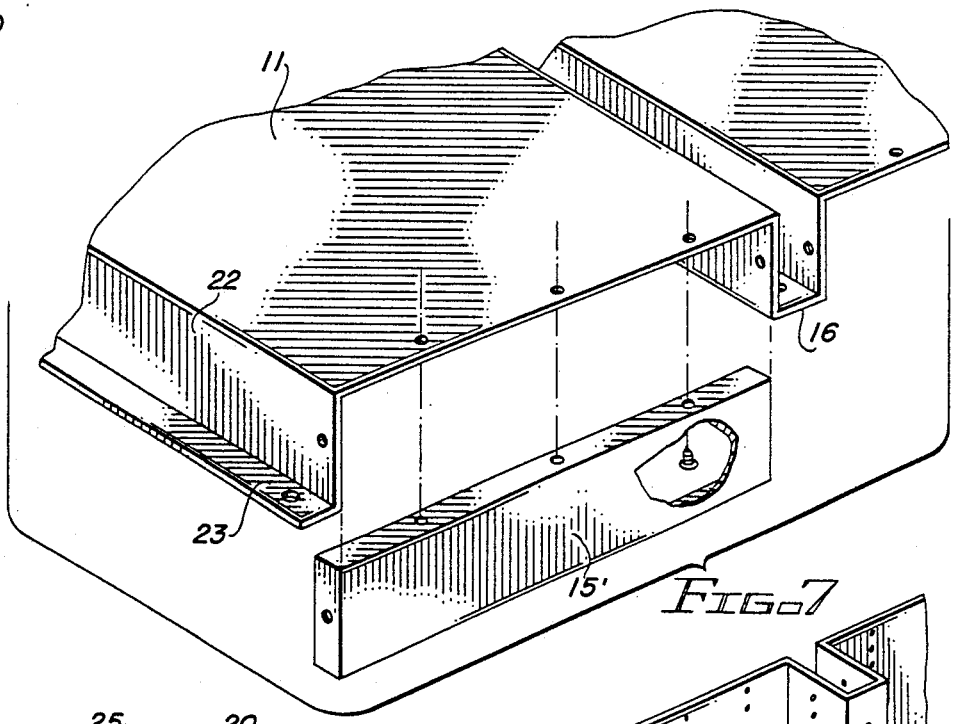
FIG. 7 is an expanded view showing the relative position of the large area panel and the bottom transverse member prior to installation of the assembly in the wall.

A side view in cross-section is shown in FIG. 3 which is taken along line 3—3 of FIG. 1 and shows the fastener 21 in a cut out portion securing the U-shaped channel member to the wall support 20. In this view, the large area panel 11 is shown at the back of the structure adjacent the exterior wall 25 of the structure. Three transverse members are shown in cross-section with the bottom and middle transverse members facing upward so as to serve as a retaining shelf as well as imparting structural rigidity to the installed storage apparatus and serving as a fire break. The top transverse member 15' is shown in FIG. 7 with its sides extending downwardly, however, this is a feature of choice and the positioning of the transverse members can be varied as desired for particular applications.

An individual transverse member 15 is shown in FIGS. 4 and 5 with upwardly extending sides surrounding a base. In practice, these elements are molded of synthetic material or formed from sheet matal and are an integral unitary structure. Fastening receiving holes 26 are provided in at least three sides to enable the transverse member to be affixed to the large area panel and the holes in the end sections of the transverse members can be affixed to the broad area surface of the vertical wall support 20 adjacent thereto. The manner of affixation to the large area panel 11 is shown in FIG. 7 wherein the top most transverse member 15' is shown as being secured to the large area panel along the back edge with the mating holes being provided for receiving nails driven into the adjacent vertical wall support. Holes are shown provided in the U-shaped panel member 16 and the combination of vertical end member 22 and depending flange 23. In installation, the installer places the large area panel in a temporary position against the vertical wall supports and selects where the transverse members 15 are to be placed in order to provide optimum storage for the intended purpose. The large area panel is then withdrawn and the affixation of the transverse members to at least the back of the large area panel is accomplished as shown in FIG. 7 and the assembly is then properly positioned against the vertical wall supports and affixed thereto. If storage of light articles is intended, the sides of the transverse members can be affixed to the adjacent U-shaped channel and the vertical end member by rivets or sheet metal screws so that only the large area panel need be fastened to the vertical wall supports 20. However, the preferred manner of installation utilizes a securing of the ends of the transverse members not only to the large area panel, but also to the adjacent large area surfaces of the wall supports in order to insure sufficient rigidity to support the storage of heavy objects.

Figure 9:
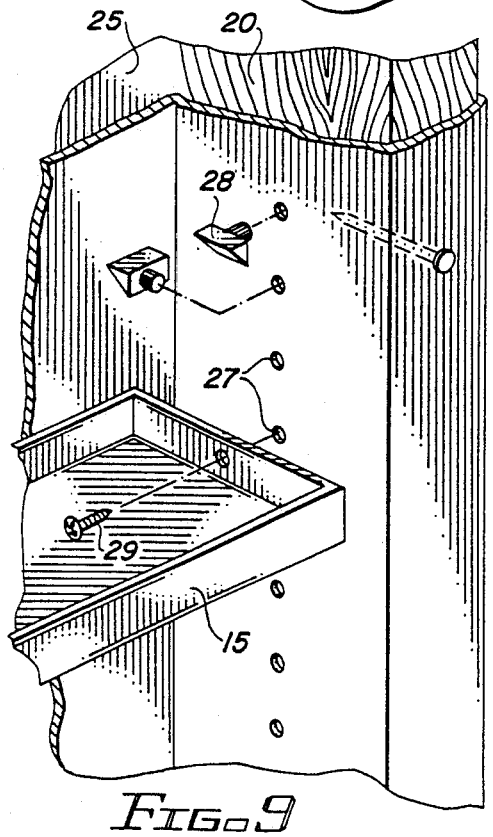
FIG. 9 is an enlarged view of a portion of the embodiment shown in FIG. 8.
Figure 8:
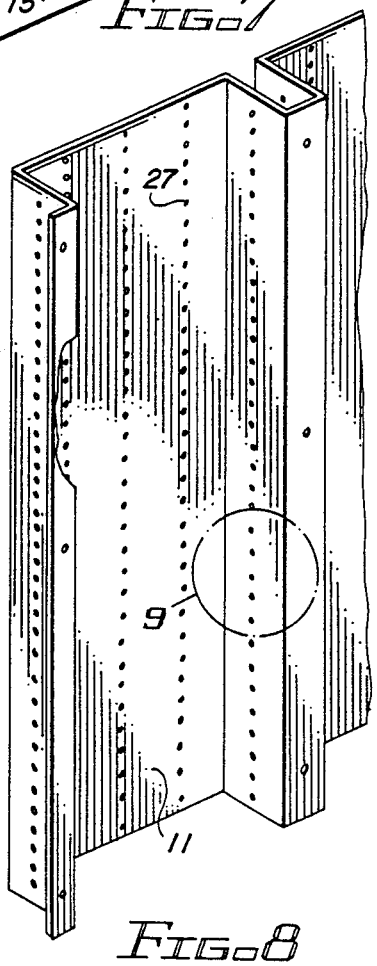
FIG. 8 is a partial view in perspective showing a second embodiment of a large area panel for use in the present invention.

In the method of manufacture of the present invention, the large area panel is formed of an integral unitary structure which may be made of molded plastic that can be trimmed or sawed by the homeowner seeking to install his own storage assembly or by the professional installer seeking to accommodate a particular space limitation. Alternatively, an embodiment has been manufactured of sheet metal which has been suitably painted prior to installation. One embodiment has been provided with a succession of preformed holes in the large area panel 11 and is shown in FIG. 8. This embodiment accommodates the lack of a riveting tool on the part of the homeowner performing his own installation as well as providing the opportunity for the use of a host of different individually insertable supporting mechanisms such as shown in FIG. 9. The individual holes 27 preformed in the large area panel are shown receiving a triangular support 28 containing an engaging insert which is received in one of the holes 27. This enables the user to later add additional shelving made, for example, from plywood after the storage apparatus has been secured to the vertical wall supports 20. FIG. 9 also shows the securing of the side of transverse member 15 by the use of threaded fastener 29. As a result, the user of an installed embodiment of this invention has the ability to remove transverse members if threaded fasteners 29 are used for the support thereof. However, the time for installation is substantially increased by the placement and securing of the transverse members 15 after the large area panel 11 has been firmly attached to the vertical supports 20. Best results for homeowner installation have been obtained by the securing of the transverse members at a location other than the final installed position since ready access is available to all sides of the large area panel and it can be moved about at will to accommodate the user or installer.

While the foregoing description has referred to specific embodiments of the invention, it is to be noted that many modifications and variations may be made therein without departing from the scope of the invention as claimed.

What I claim is:

1. Storage apparatus for placement in an opening in a wall containing a number of uniformly spaced vertical wall support members which comprises:

(a) a large area panel having opposing vertical edges, said panel being dimensioned for placement in the wall opening and including at least one vertical receiving member for engagement with a vertical wall support member;

(b) vertical end members orthogonally affixed to said opposing edges of said panel and horizontally spaced in accordance with the spacing of the vertical support members;

(c) flange members orthogonally affixed to said vertical end members and extending outwardly therefrom parallel to said large area panel, the placement of said panel in the wall opening resulting in said end and flange members contacting adjacent surfaces of said support members for attachment thereto; and (d) a plurality of transverse members dimensioned to fit between adjacent support members for attachment to said panel for imparting structural support thereto.

2. Apparatus in accordance with claim 1 wherein said large area panel, vertical end members and flange members are an integral unitary structure.

3. Apparatus in accordance with claim 2 wherein said integral unitary structure comprises a molded plastic structure.

4. Apparatus in accordance with claim 2 wherein said transverse members are dimensioned to fit between the vertical receiving member and the vertical end members of said panel.

5. Apparatus in accordance with claim 4 wherein said large area panel includes a plurality of spaced vertical receiving members formed therein at spaced intervals to receive a corresponding plurality of wall support members therein, said transverse members dimensioned to be received therebetween.

6. Apparatus in accordance with claim 4 wherein said transverse members are provided with depending flanges for attachment to the large area panel.

7. Apparatus in accordance with claim 6 wherein said transverse members are provided with depending flanges which extend along the edges thereof.

* * * * *